United States Patent [19]

Freeland

[11] Patent Number: 4,661,044

[45] Date of Patent: Apr. 28, 1987

[54] PUMP HAVING A BUSHING REMOVAL MECHANISM

[75] Inventor: Bruce E. Freeland, Seneca Falls, N.Y.

[73] Assignee: Goulds Pumps, Incorporated, Seneca Falls, N.Y.

[21] Appl. No.: 737,517

[22] Filed: May 24, 1985

[51] Int. Cl.[4] ..... F01D 25/24

[52] U.S. Cl. ..... 415/201; 415/170 R; 415/213 A; 277/112; 403/348

[58] Field of Search ..... 415/170 A, 170 R, 171, 415/172 R, 174, 118, 201, 213 A, 219 R, 219 C; 416/174; 417/424, 359, 360; 277/112, 47, 48, 69, 50; 384/448, 295, 396, 441; 403/348, 349; 285/16, 90, 361, 376, 396, 402

[56] References Cited

U.S. PATENT DOCUMENTS

| | | | |
|---|---|---|---|
| 1,084,885 | 1/1914 | Johnson | 277/112 |
| 2,434,018 | 1/1948 | Stepanoff | 415/213 R |
| 2,947,260 | 8/1960 | Hornschuch | 415/201 |
| 3,079,865 | 3/1963 | Lipe et al. | 415/201 |
| 3,168,869 | 2/1965 | Sieghartner | 415/170 A |
| 3,248,133 | 4/1966 | Michnoff | 285/376 |
| 3,249,057 | 5/1966 | Callahan | 417/424 |
| 3,413,926 | 12/1968 | Ayson | 415/131 |
| 3,601,498 | 8/1971 | Schroeder | 417/360 |
| 3,661,398 | 5/1972 | Hummer | 277/87 |
| 3,704,960 | 12/1972 | Zagar | 417/424 |
| 3,759,628 | 9/1973 | Kempf | 415/219 C |
| 3,881,841 | 5/1975 | Straniti | 415/131 |
| 4,176,815 | 12/1979 | Davidson et al. | 403/349 |
| 4,338,062 | 7/1982 | Neal | 415/213 A |
| 4,459,785 | 7/1984 | Zimmer | 403/348 |
| 4,496,281 | 1/1985 | Noack | 415/219 C |

*Primary Examiner*—Robert E. Garrett
*Assistant Examiner*—John Kwon
*Attorney, Agent, or Firm*—Bean, Kauffman & Bean

[57] ABSTRACT

A mechanism is disclosed for use in permitting inspection and/or replacement of a seal chamber bushing of a centrifugal or axial flow pump at a point of pump installation and without necessitating disassembly of the pump rotating assembly. The mechanism includes a bushing holder, which is removably fitted within a pump shaft access or receiving opening extending through a pump backplate or stuffing box cover; and a gland or seal chamber housing, which is removably mounted on the backplate and releasably coupled to the bushing holder in a manner facilitating removal of the latter from within the pump shaft access opening.

10 Claims, 5 Drawing Figures

Fig. 1.
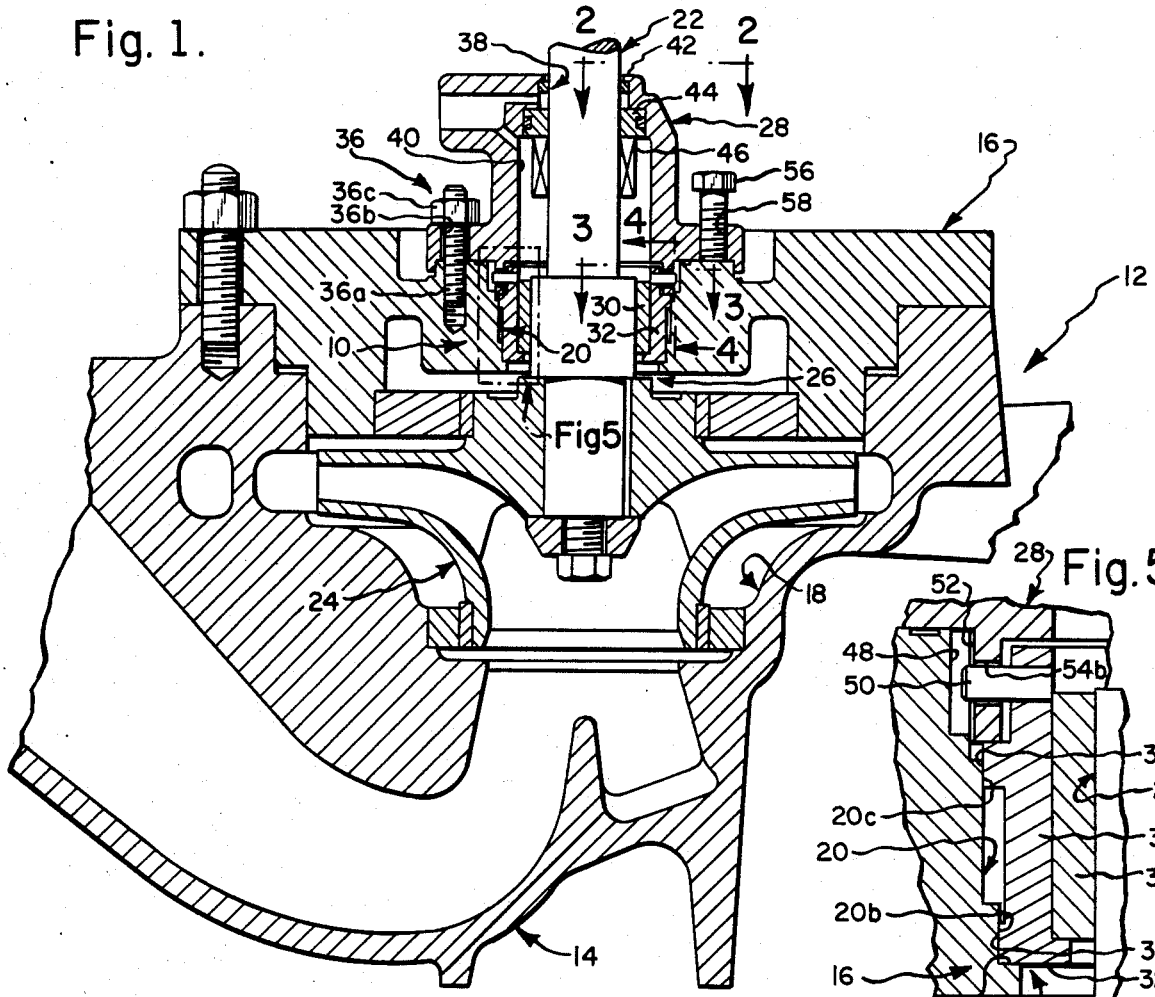
Fig. 5.
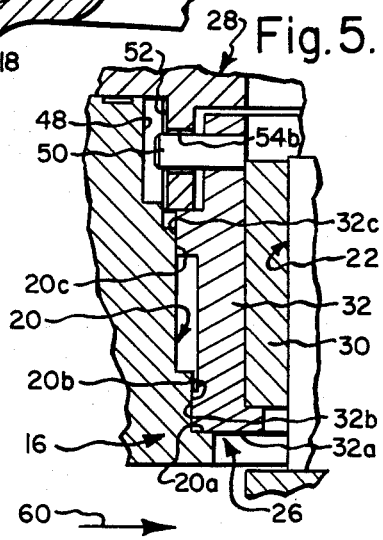
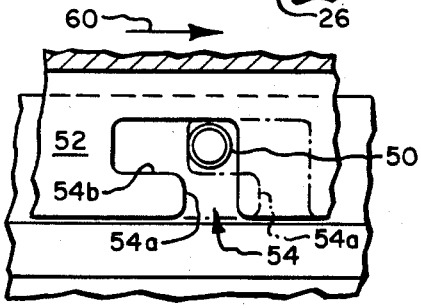
Fig. 4.
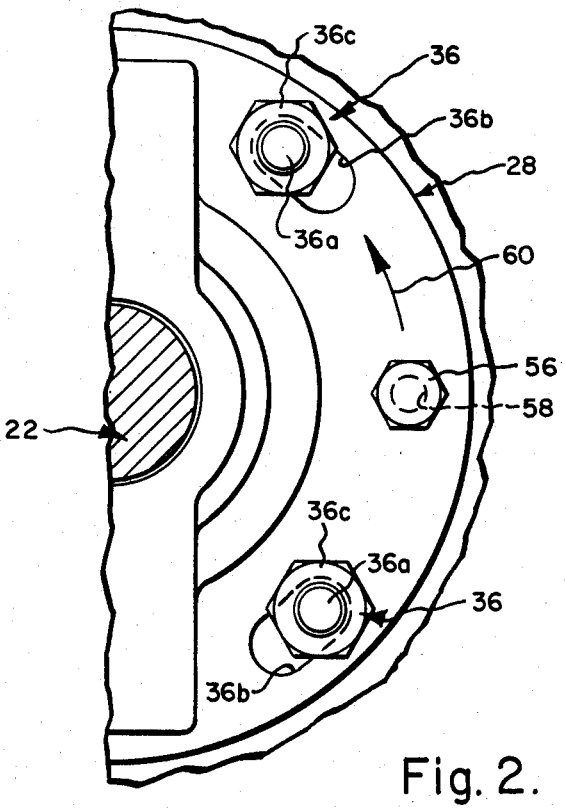
Fig. 2.
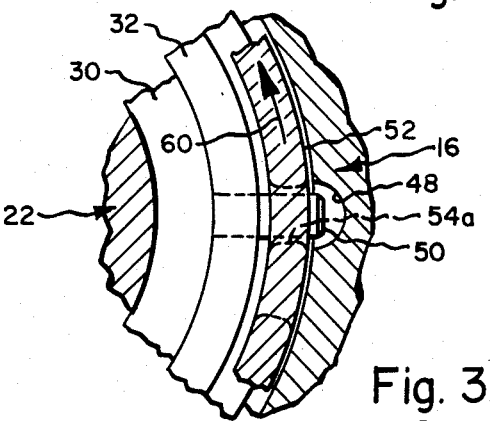
Fig. 3.

PUMP HAVING A BUSHING REMOVAL MECHANISM

BACKGROUND OF THE INVENTION

It has been the practice in certain centrifugal or axial flow pumps to provide a bushing or bearing for supporting the pump impeller mounting end of a pump shaft at the point it passes through a pump backplate or stuffing box cover.

Typically, bushings used for supporting pump shafts in this manner are sleeve bushings formed of graphite or other suitable bearing material, which are force fitted within a pump shaft access or through opening defined by a pump backplate. Alternatively, bushings are supported within bushing holders, which are force fitted within such access opening.

It is desirable to permit inspection of such bushings for evidence of wear or deterioration in order to permit bushing replacement before total failure. However, there has heretofore been no way of gaining access to such bushings for inspection and/or replacement purposes without first effecting complete removal and disassembly of the pump rotating assembly including for example the pump shaft, impeller, backplate or stuffing box cover and gland or seal chamber housing. It is normally very inconvenient to disassemble a pump rotating assembly in the field or at the point of pump installation, and thus it has been the practice to transport the assembly to a workshop or area designated for maintenance purposes. Thus, a decided drawback of present practice is the time and expense required to effect inspection and/or replacement of pump shaft supporting bushings of the type described.

SUMMARY OF THE INVENTION

The present invention is directed towards a mechanism for facilitating the inspection and/or replacement of a pump shaft or seal chamber bushing at the point of pump installation and without requiring disassembly of the rotating assembly of the pump.

More particularly, the bushing removal mechanism of the present invention generally includes means for removably connecting a gland or seal chamber housing to a bushing such that the bushing can be extracted from within a pump shaft access or through opening of a backplate or stuffing box cover upon disassembling movement of such gland in a direction away from such backplate. The mechanism avoids the need to remove or disassemble the pump shaft, impeller and backplate portion of the rotating assembly of the pump, and permits removal, inspection and replacement of a bushing to be accompanied at the point of pump installation.

DRAWINGS

The nature and mode of operation of the present invention will now be more fully described in the following detailed description taken with the accompanying drawings wherein:

FIG. 1 is a sectional view taken vertically through a centrifugal pump and showing the bushing removal mechanism of the present invention;

FIG. 2 is a partial top plan view taken generally along the line 2—2 in FIG. 1;

FIG. 3 is a sectional view taken generally along the line 3—3 in FIG. 1;

FIG. 4 is a sectional view taken generally along the line 4—4 in FIG. 1; and FIG. 5 is an enlarged fragmentary view of the area designated as FIG. 5 in FIG. 1.

DETAILED DESCRIPTION

Reference is first made to FIG. 1 wherein a bushing removal mechanism formed in accordance with a preferred form of the present invention is generally designated as 10 and shown for example as being used in an otherwise conventional vertical, single stage, centrifugal pump 12.

To facilitate description of the invention, pump 12 will first be generally described as comprising a pump casing 14; a backplate or stuffing box cover 16, which cooperates with pump casing 14 to define a pump chamber 18 and is formed with an access opening 20 extending therethrough and communicating with pump chamber 18; a pump shaft 22, which supports an impeller 24 adjacent its lower or inner end within pump chamber 18 and extends vertically upwardly through access opening 20 for removable connection to a motor drive shaft, not shown, via a suitable, rigid coupling, also not shown; bushing or bearing means 26 fitted with access opening 20 for providing a support for pump shaft 22 adjacent impeller 24; and a gland or seal chamber housing 28.

The illustrated construction of bushing means 26 is conventional from the standpoint that it comprises a sleeve bushing or bearing 30 of graphite or other suitable bearing material sized to engage with pump shaft 22; and a bushing holder 32 for supporting sleeve bushing 30 within access opening 20, wherein the bushing holder and access opening are shaped to provide abutment surfaces **32*a* and 20*a* cooperating to define an assembled or fully inserted position of bushing means 26 within the access opening, which is relatively adjacent pump chamber 18, as best shown in FIG. 1**.

Further, the illustrated construction of gland 28 is conventional from the standpoint that it is removably fixed to backplate 16 outwardly of pump chamber 18 and about access opening 20 by means of a plurality of fastener devices 36, such as may be defined by backplate mounted threaded stud portions **36*a* removably received within gland mounting openings 36*b* and nuts 36*c*; and is provided with a through aperture 38 to permit passage of an outer or upper end of pump shaft 22 therethrough. Gland 28 defines a seal chamber 40 for receiving fluid leaking outwardly along pump shaft 22 and mounts seal devices 42 and 44. Typically, a mechanical seal device 46 is mounted on pump shaft 22 for sealing engagement with seal device 44**.

In accordance with the present invention, an otherwise conventional backplate 16 is modified to provide access opening 20 with a stepped diameter configuration wherein its inner surface is defined in part by axially spaced small and large diameter support wall portions **20*b* and 20*c*, which are disposed relatively adjacent to and remote from pump chamber 18; and locating slots 48, which extend lengthwise of and communicate with access opening 20, as best shown in FIG. 5**.

Further, bushing holder 32 is best shown in FIG. 5 as being modified to provide its outer surface with axially spaced relatively small and relatively large diameter wall portions **32*b* and 32*c* arranged for slidable engagement with support wall portions 20*b* and 20*c*, respectively, to provide a relatively small clearance fit support for the bushing holder when in assembled position within access opening 20, while providing a relatively loose fit during a substantial portion of travel of the bushing holder towards and away from such assembled position. Thus, it is relatively easy to insert and withdraw bushing means 26 from within access opening 20 with a relatively close fit between parts being provided only at and immediately adjacent the assembled position, as required to properly position and support bushing sleeve 30. Bushing holder 32 further departs from prior holder constructions in that it is fitted with pin means, such as may be defined by a pair of locating pins 50, which extend radially outwardly therefrom and are annularly spaced one from another, such that their outer ends are disposed for receipt one within each of locating slots 48 to constrain holder 32 from rotation relative to backplate 16, as best shown in FIG. 3**.

Gland 28 departs from prior similar constructions in several important respects. First, gland mounting openings 36b are arcuately shaped and disposed concentrically of aperture 38, such that upon loosening of nuts **36*c*, studs 36*a* serve to support or guide the gland for rotation between first and second positions shown in full and broken line in FIG. 4. Secondly, gland 28 is provided with a depending flange 52 sized and arranged for receipt within access opening 20 concentrically outwardly of bushing holder 32. Flange 52 is provided with slot recesses 54 of generally L-shaped configuration intended to be associated one with each of pins 50. Each of slot recesses 54 includes an entrance portion 54*a*, which is arranged to extend axially of flange 52 for permitting releasably insertion of pins 50 therewithin when gland 28 is disposed in its first position; and a latching portion 54*b*, which extends transversely from entrance portion 54*a* and engages with an associated pin 50 to connect bushing means 26 to gland 28 upon rotation of the latter into its second position. Thus, pins 50 and slot recesses 54 serve to releasably interconnect bushing means 26 and gland 28**.

Gland 28 further departs from conventional constructions in that it includes means in the form of a plurality of jack screws 56 supported within threaded apertures 58 for use in selectively effecting disassembling movement of the gland upwardly away from its normal or assembled condition shown in FIG. 1, in which the gland is normally releasably clamped by fastener devices 36.

During normal operation of pump 12, its parts or elements reside in their relative positions shown in FIG. 1 with bushing means 26 disposed in its assembled position and gland 28 clamped or locked in its assembled condition; the gland assuming, as by way of example, its first rotatable position shown in FIG. 2 and in full line in FIG. 4. When it is desired to inspect or replace sleeve pushing 30, service personnel would, for example, disconnect the upper or outer end of pump shaft 22 from its associated motor drive shaft; remove nuts 36; rotate gland 28 as indicated by arrows 60 in FIGS. 2–4 into its second position in order to seat or engage pins 50 within latching portions **54*b* of slots recesses 54; and screw jack screws 56 in a step-wise manner towards and into engagement with backplate 16 such that the gland is raised or moved away from its assembled condition without effecting tilting thereof, and bushing means 26 is concurrently raised or moved axially away from its assembled position. Jack screws 56 would preferably be of a length sufficient to permit same to remove bushing holder wall portions 32*b* and 32*c* axially away from engagement with wall support portions 20*b* and 20*c*. Further, the diameter, thread characteristics and number of jack screws 56 would be chosen such that they can without injury to themselves effect extraction of a bushing holder even when locked in place by a rust condition. Thereafter, a very loose fit exists between bushing holder 32 and access opening 20, so as to permit gland 28 to be manually or mechanically lifted sufficiently to fully extract the bushing means from within the access opening without fear of damage and then to remove the gland and bushing means from the outer end of pump shaft 22. Bushing holder 32 may then be manually separated or uncoupled from gland 28 to permit inspection of sleeve bushing 30** and/or replacement thereof, if defective.

After inspection of the original sleeve bushing 30 and/or the replacement thereof with a new sleeve bushing inserted within bushing holder 32, bushing means 26 is fitted over the upper or outer end of pump shaft 26 and then reinserted within access opening 20 with pins 50 being arranged for alignment with locating slots 54. Upon seating of bushing means 26 in its assembled position, gland 28 is then moved axially of pump shaft 22 until it again assumes its assembled condition with care being taken to first back off the previously extended jack screws 56, to arrange mounting openings **36*b* in alignment with studs 36*a* and to arrange entrance portions 54*a* in alignment with pins 50. Nuts 36*c* are then tightened to lock gland 28 in assembled condition and pump shaft 22 is again connected to its associated motor shaft to complete a disassembly/assembly operation. Depending upon manufacturing tolerances, the clearances existing between bushing holder wall portions 32*b* and 32*c* and wall support portions 20*b* and 20*c*, may permit bushing holder 32 to be placed in assembled position by hand or with the aid of means, such as a rubber mallet. Alternatively, bushing holder 32 may be forced into fully seated position by threading nuts 36*c* down on studs 36*a* with the lower edge surface of flange 52 bearing downwardly on the bushing holder, as shown in FIG. 5**.

From the foregoing, it will be appreciated that a decided advantage of the presently disclosed construction is that it permits the removable mounting of a pump shaft supporting bushing in the field and without necessitating removal or disassembly of the impeller and backplate of a pump.

While the present invention has been described as by way of example for use in connection with a vertical, single stage centrifugal pump, it will be understood that the invention is not limited to this specific pump construction and orientation.

What is claimed is:

1. A pump comprising in combination:

a pump casing;

a backplate cooperating with said pump casing to define a pump chamber, said backplate having an access opening extending therethrough and communicating with said pump chamber and providing an abutment surface facing away from said pump chamber;

a pump shaft having an inner end and an outer end, said inner end extending through said access opening and supporting an impeller within said pump chamber for pumping fluid therethrough;

bushing means for supporting said inner end of said pump shaft for rotation relative to said backplate, said backplate removably supporting said bushing means within said access opening by sliding surface engagement between an inner surface of said access opening and an outer surface of said bushing means, wherein an assembled position of said bushing means within said access opening is defined by engagement of said bushing means with said abutment surface, said backplate having means for constraining said bushing means against rotational movement relative thereto while said bushing means is in said assembled position;

a gland having a through aperture to permit passage of said outer end of said pump shaft therethrough;

means for removably fixing said gland to said backplate for releasably retaining said bushing means in said assembled position, while permitting rotational movements of said gland relative to said backplate; and connecting said operable to response to said rotational movements of said gland while said bushing means is in said asembled position for removably connecting said gland to said bushing means for extracting the latter from said assembled position within said access opening upon disassembling movement of said gland in a direction away from said backplate and towards said outer end of said pump shaft wherein said inner surface of said access opening is of stepped diameter configuration having axially spaced relatively small and larger diameter support wall portions disposed axially adjacent to and remote from said pump chamber, respectively; and said bushing means includes a sleeve bushing internally sized for engagement with said pump shaft and a bushing holder for supporting said sleeve bushing within said access opening, said bushing holder engages with said abutment surface to define said assembled position and said outer surface of said bushing holder having axially spaced relatively small and relatively large diameter wall portions arranged for slidably engagement with said relatively small and large diameter support wall portions to provide a relatively small clearance fit support for said bushing holder when said bushing means is in said assembled position, while providing a relatively loose fit for said bushing holder relative to said backplate during a substantial portion of travel of said bushing means axially of said pump shaft towards and away from said assembled position.

2. A pump according to claim 1, wherein said gland includes disassembly means for effecting said disassembling movement of said gland.

3. A pump according to claim 2, wherein said diassembling means includes jack screws supported within threaded apertures extending through said gland for engagement with said backplate.

4. A pump according to claim 1, wherein said means for removably fixing said gland to said backplate includes a plurality of arcuately shaped mounting openings formed in said gland and disposed concentrically of said through aperture and threaded fastener devices connected to said backplate and having stud portions removably received within said mounting openings, said stud portions and said mounting openings cooperating to support said gland for said rotational movements between first and second positions in which said connecting means releases said bushing means from and connects said bushing means to said gland.

5. A pump according to claim 4, wherein said gland includes means for effecting said disassembling movement of said gland, which comprises jack screws threadably received within apertures extending through said gland for engagement with said backplate.

6. A pump according to claim 1, wherein said bushing holder includes pin means extending radially outwardly therefrom, said means for constraining said bushing means against rotational movement is a locating slot means extending axially of and communicating with said access opening for removably receiving outer ends of said pin means.

7. A pump according to claim 6, wherein said pin means cooperates with slot recesses formed in said gland to define said connecting means.

8. A pump according to claim 7, wherein said means for removably fixing said gland to said backplate includes a plurality of arcuately shaped mounting openings formed in said gland and disposed concentrically of said through aperture and threaded fastener devices connected to said backplate and having stud portions removably received within said mounting openings, said stud portions and said mounting openings cooperating to support said gland for said rotational movements between first and second positions thereof in which said connecting means releases said bushing means from and connects said bushing means to said gland, said slot recesses having a generally L-shaped configuration including an entrance portion extending in the direction axially of said pump shaft for permitting releasably insertion of said pin means within said slot recesses when said gland is in said first position thereof and a latching portion extending transversely from said entrance portion and engaging with said pin means to connect said bushing means to said gland upon rotation of said gland towards said second position thereof.

9. A pump according to claim 8, wherein said gland includes means for effecting said disassembling movement of said gland in the form of jack screws threadably supported by said gland for engagement with said backplate.

10. A pump according to claim 1, wherein said connecting means includes pin means extending radially from said bushing means and slot means formed in said gland for removably receiving said pin means upon said rotational movements of said gland, and said means for constraining said bushing means against rotational movement includes locating slot means extending axially of and communicating with said access opening for removably receiving outer ends of said pin means when said bushing means is in said assembled position.

* * * * *

UNITED STATES PATENT AND TRADEMARK OFFICE

CERTIFICATE OF CORRECTION

PATENT NO. : 4,661,044

DATED : April 28, 1987

INVENTOR(S) : Bruce E. Freeland et al

It is certified that error appears in the above-identified patent and that said Letters Patent are hereby corrected as shown below:

[75] "Inventor: Bruce E. Freeland, Seneca Falls, N.Y."
should be
-- Inventors: Bruce E. Freeland, Seneca Falls; John C. Salerno, Waterloo, both of N.Y. --.

Col. 3, line 54 - "pushing" should be -- bushing --.

Col. 5, line 17 - "said" should be -- means --;
the first occurrence of "to" should be -- in --.

Signed and Sealed this

Eleventh Day of August, 1987

*Attest:*

DONALD J. QUIGG

*Attesting Officer*

*Commissioner of Patents and Trademarks*